US006770853B2

(12) United States Patent
Krieger et al.

(10) Patent No.: US 6,770,853 B2
(45) Date of Patent: Aug. 3, 2004

(54) PWM CONTROLLER FOR DC POWERED HEATING BLANKET

(75) Inventors: Michael Krieger, Miami Beach, FL (US); Bruce Randolph, Ft. Lauderdale, FL (US)

(73) Assignee: Vector Products, Inc., Ft. Lauderdale, FL (US)

( * ) Notice: Subject to any disclaimer, the term of this patent is extended or adjusted under 35 U.S.C. 154(b) by 62 days.

(21) Appl. No.: 10/277,031

(22) Filed: Oct. 22, 2002

(65) Prior Publication Data

US 2004/0074897 A1 Apr. 22, 2004

(51) Int. Cl.[7] ..... H05B 1/02

(52) U.S. Cl. ..... 219/497; 219/212; 219/501; 219/505; 2/905

(58) Field of Search ..... 219/212, 494, 219/497, 499, 501, 505, 535, 483–486; 2/905, 906

(56) References Cited

U.S. PATENT DOCUMENTS

| | | | |
|---|---|---|---|
| 3,201,580 | A | 8/1965 | Moore |
| 3,793,515 | A | 2/1974 | Park |
| 3,800,136 | A | 3/1974 | Edelson |
| 3,821,600 | A | 6/1974 | Wesner |
| 4,055,790 | A | 10/1977 | Gerding et al. |
| 4,092,711 | A | 5/1978 | Gerding et al. |
| 4,237,405 | A | 12/1980 | Kellis |
| 4,238,709 | A | 12/1980 | Wallace |
| 4,326,161 | A | 4/1982 | Kreinberg |
| 4,410,835 | A | 10/1983 | Zabroski |
| 4,471,422 | A | 9/1984 | Hierholzer, Jr. |
| 4,499,525 | A | 2/1985 | Mallory |
| 4,580,090 | A | 4/1986 | Bailey et al. |
| 4,604,517 | A | 8/1986 | Barry |
| 4,621,313 | A | 11/1986 | Kiteley |

(List continued on next page.)

OTHER PUBLICATIONS

"Introduction to Pulse Width Modulation (PWM)," Michael Barr, http://www.netrino.com/Publications/Glossary/PWM.html, pp. 1–4, 2001, CMP Media, LLC.

"IM193/LM293/LM393/LM2903 Low Power Low Offset Voltage Dual Comparators," National Semiconductor Corporation, www.national.com, pp. 1–13, Aug. 2000.

*Primary Examiner*—Mark Paschall
(74) *Attorney, Agent, or Firm*—Venable LLP; Robert Kinberg; Jeffrey W. Gluck

(57) ABSTRACT

A PWM-based controller for controlling a voltage applied to a DC-powered electric heating blanket from a power source includes a square wave producing circuit for connection in the circuit with the battery and the blanket. The square wave producing circuit produces a variable duty cycle square wave for controlling application of power to the blanket in accordance with the duty cycle of the square wave. The square wave producing circuit has a control input for varying the duty cycle of the square wave in response to a voltage at the control input. The voltage at the control input may be set manually using a voltage varying circuit connected to the power source. A low voltage detection circuit may also be connected to the power source and coupled to the control input of the square wave producing circuit for automatically producing a voltage that decreases the duty cycle of the square wave when the battery voltage decreases to or below a predetermined level.

27 Claims, 3 Drawing Sheets

U.S. PATENT DOCUMENTS

| | | | | |
|---|---|---|---|---|
| 4,816,970 | A | | 3/1989 | Garcia, Jr. |
| 4,887,006 | A | | 12/1989 | Kuratami |
| 4,950,868 | A | | 8/1990 | Moss et al. |
| 5,021,679 | A | | 6/1991 | Fairbanks |
| 5,023,430 | A | | 6/1991 | Brekkestran et al. |
| 5,032,705 | A | | 7/1991 | Batcheller et al. |
| 5,038,728 | A | | 8/1991 | Yoshida et al. |
| 5,097,180 | A | | 3/1992 | Ignon et al. |
| 5,097,829 | A | | 3/1992 | Quisenberry |
| 5,105,067 | A | | 4/1992 | Brekkestran et al. |
| 5,854,617 | A | | 12/1998 | Lee et al. |
| 5,857,061 | A | | 1/1999 | Chang et al. |
| 5,944,407 | A | | 8/1999 | Lynch et al. |
| 5,986,241 | A | | 11/1999 | Funahashi |
| 6,040,660 | A | | 3/2000 | Schmidt et al. |
| 6,107,787 | A | | 8/2000 | Wand |
| 6,142,974 | A | * | 11/2000 | Kistner et al. ..... 604/113 |
| 6,222,162 | B1 | | 4/2001 | Keane |
| 6,246,184 | B1 | | 6/2001 | Salerno |
| 6,305,818 | B1 | | 10/2001 | Lebens et al. |
| 6,317,347 | B1 | | 11/2001 | Weng |
| 6,617,757 | B2 | | 9/2003 | Vazquez Carazo et al. |
| 2002/0008501 | A1 | | 1/2002 | Telefus et al. |

* cited by examiner

PWM CONTROLLER FOR DC POWERED HEATING BLANKET

BACKGROUND OF THE INVENTION

1. Field of the Invention

The present invention is directed to a DC-powered electric blanket having a PWM-based control circuit. The invention is further directed to such a DC-powered electric blanket utilizing a PWM control circuit having battery conservation features and an associated method of controlling such an electric blanket.

2. Description of Related Art

It is known to adjust the output power of a battery providing power to a device, such as a spotlight, table lamp or other such source of light. Considering, for example, the context of lighting devices, one known circuit incorporates pulse width modulation (PWM) to automatically increase the duty cycle of the signal that provides power to the lamp as the voltage of the battery decreases, to thereby maintain a constant power supply and light intensity. It is also known to manually decrease the duty cycle to reduce the intensity of the light as the battery voltage decreases. Examples of such control circuits are described in U.S. Pat. No. 4,499,525 to Mallory and in U.S. Pat. No. 6,040,660 to Schmidt et al., which are incorporated herein by reference. Note that, in the case of the former, the light intensity is maintained at the expense of battery conservation.

Pulse-width modulation (PWM) based control techniques are known in heating devices, as well. For example, U.S. Pat. No. 4,950,868 to Moss et al. and U.S. Pat. No. 5,023,430 to Brekkestran et al. describe electrically-heated clothing using PWM-based control circuits.

U.S. Pat. No. 6,122,162 to Keane discloses an electric heating blanket having a control circuit that monitors resistivity of a heating element as a basis for control. While Keane suggests control mechanisms that vaguely resemble PWM-based control, they are not true PWM-based control mechanisms.

Co-pending U.S. patent application Ser. No. 10/277,087, entitled, "PWM Controller with Automatic Low Battery Reduction Circuit and Lighting Device Incorporating the Controller," filed Oct. 22, 2002, commonly assigned and incorporated by reference herein in its entirety, presents a PWM-based control circuit and a lighting device using the circuit. The PWM-based control circuit disclosed therein includes a low voltage detection circuit that permits the control circuit to detect when the voltage of a power supply goes below a predetermined level. In such circumstances, the control circuit decreases the duty cycle of a PWM control signal in order to conserve power. Manual adjustment of duty cycle is also enabled.

It would be useful if there were a DC-operated heating blanket that incorporated a PWM-based controller, especially one that includes such battery saving features.

SUMMARY OF THE INVENTION

It is an object of the invention to provide a means by which to permit a user to manually adjust the intensity of an electric heating blanket, and which automatically reduces power drawn from a power source to the device as the power possessed by the power source decreases.

It is a further object of the invention to provide a means for varying the heat intensity of a DC-powered electric heating blanket that can be manually adjusted and a means for automatically reducing the power drawn from the DC power source by the blanket as the voltage of the power source decreases.

It is yet a further object of the invention to provide a DC-powered electric heating blanket utilizing PWM-based control.

The above and other objects are accomplished in accordance with the invention by the provision of a PWM-based controller for controlling a voltage provided from a power source to a DC-operated electric heating blanket. The controller comprises a square wave producing circuit that produces a variable-duty-cycle square wave for applying voltage to the blanket. A voltage varying circuit is included for producing a selectively variable voltage that is fed to a control input of the square wave producing circuit for controlling a duty cycle of the variable-duty-cycle square wave. The controller further includes a low voltage detection circuit that monitors the power source and is also coupled to the control input of the square wave producing circuit; the low voltage detection circuit automatically produces a voltage that decreases the duty cycle of the variable-duty-cycle square wave when the voltage of the power source decreases below a predetermined level.

The above and other objects are also accomplished in accordance with the invention by the provision of a PWM-based method for controlling a voltage provided from a power source to a DC-operated electric heating blanket. The method comprises step of generating a variable-duty-cycle square wave for applying voltage to the blanket. The method further includes the step of controlling a duty cycle of the variable-duty-cycle square wave. The method further includes steps of detecting a low voltage condition of the power source and using the result to control the duty cycle of the variable-duty-cycle square wave. More specifically, as the detected voltage decreases below a predetermined level, the duty cycle of the variable-duty-cycle square wave is decreased.

BRIEF DESCRIPTION OF THE DRAWINGS

Further objects, advantages and benefits of the invention will be come apparent from the following detailed description of the invention when considered in conjunction with the accompanying drawings, in which.

DETAILED DESCRIPTION OF THE INVENTION

According to the invention, a PWM-based controller is provided for a DC-powered electric heating blanket. The controller permits manual control by permitting a user to adjust the pulse width of pulses applied to control the blanket, thus permitting the user to vary the heat intensity of the blanket. In one embodiment, the PWM controller of the present invention also gradually and automatically decreases the intensity of the output of the blanket, thereby increasing battery life. This is achieved by continually sensing the voltage of the battery and decreasing the duty cycle of the aforementioned pulses as the voltage of the battery decreases.

Figure 1:
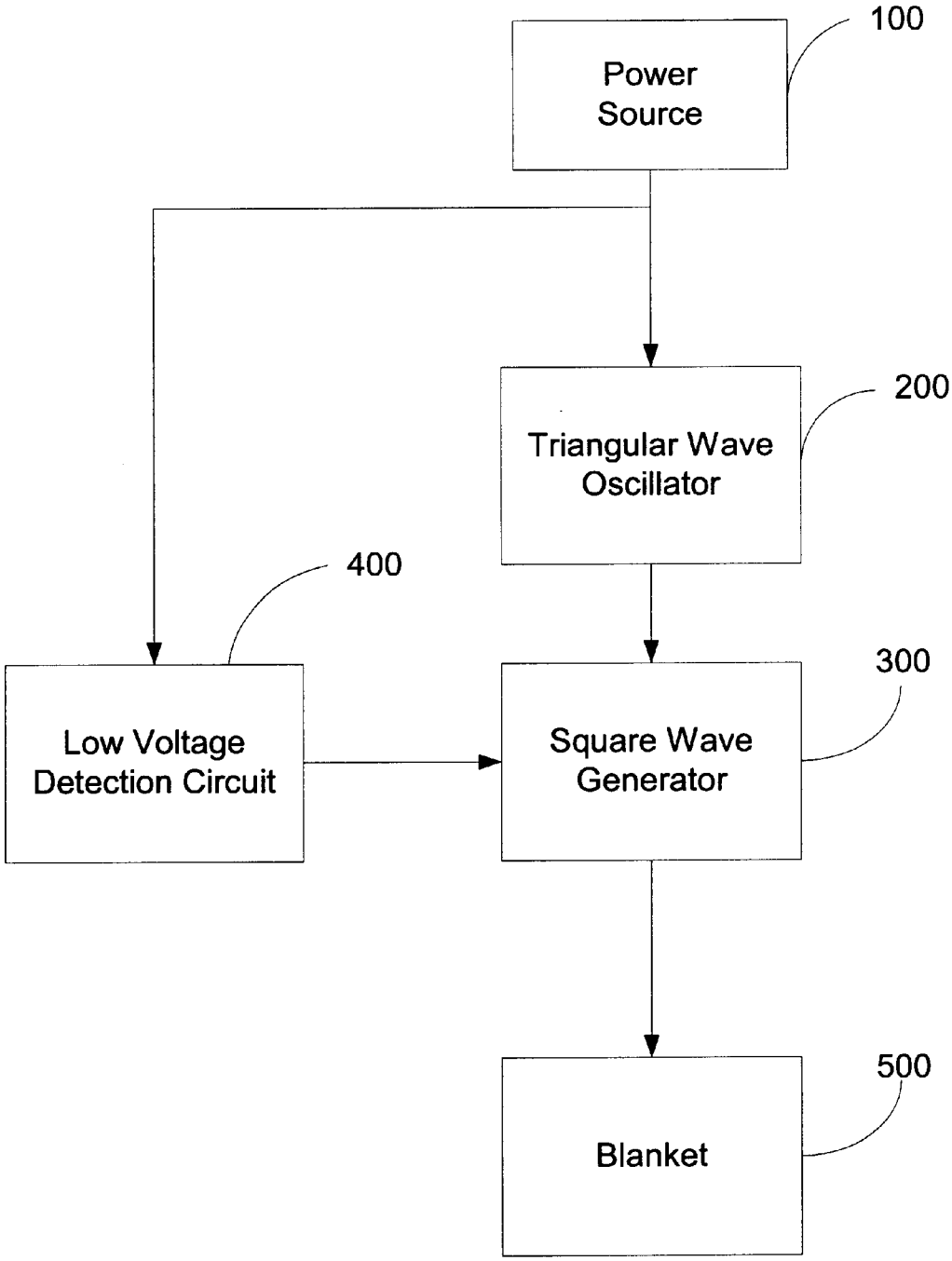
FIG. 1 is a block diagram of a control circuit according to an embodiment of the invention.

FIG. 1 depicts a block diagram of such a controller, including the low voltage detection feature. While manual control is included in the controller, it is not explicitly shown in FIG. 1. FIG. 1 shows a power source 100 supplying power to a triangular wave oscillator 200. The output of triangular wave oscillator 200 is supplied to square wave generator 300. Square wave generator 300 is controllable to adjust the duty cycle of a square wave output. Low voltage detection circuit 400 monitors the output of power source 100 and provides a control output to square wave oscillator 300. The control output is dependent on the detected output of power source 100 and is used to control the duty cycle of the square wave output of square wave oscillator 300. A manual control input (not shown), also controlling the duty cycle of the output of square wave oscillator 300, is also provided to square wave generator 300; this may be provided either directly to square wave generator 300 or through low voltage detection circuit 400. The output of square wave oscillator 300 is provided to heating blanket 500 (specifically, a heating element or other electric heating means within the heating blanket). In a preferred embodiment, the square wave output of square wave oscillator 300 will be used to control a switching circuit (e.g., a transistor configured to switched on and off) to turn the blanket on and off according to the duty cycle of the square wave output, and to thereby vary the intensity of the heat output of the blanket according to the duty cycle of the square wave output.

Figure 2:
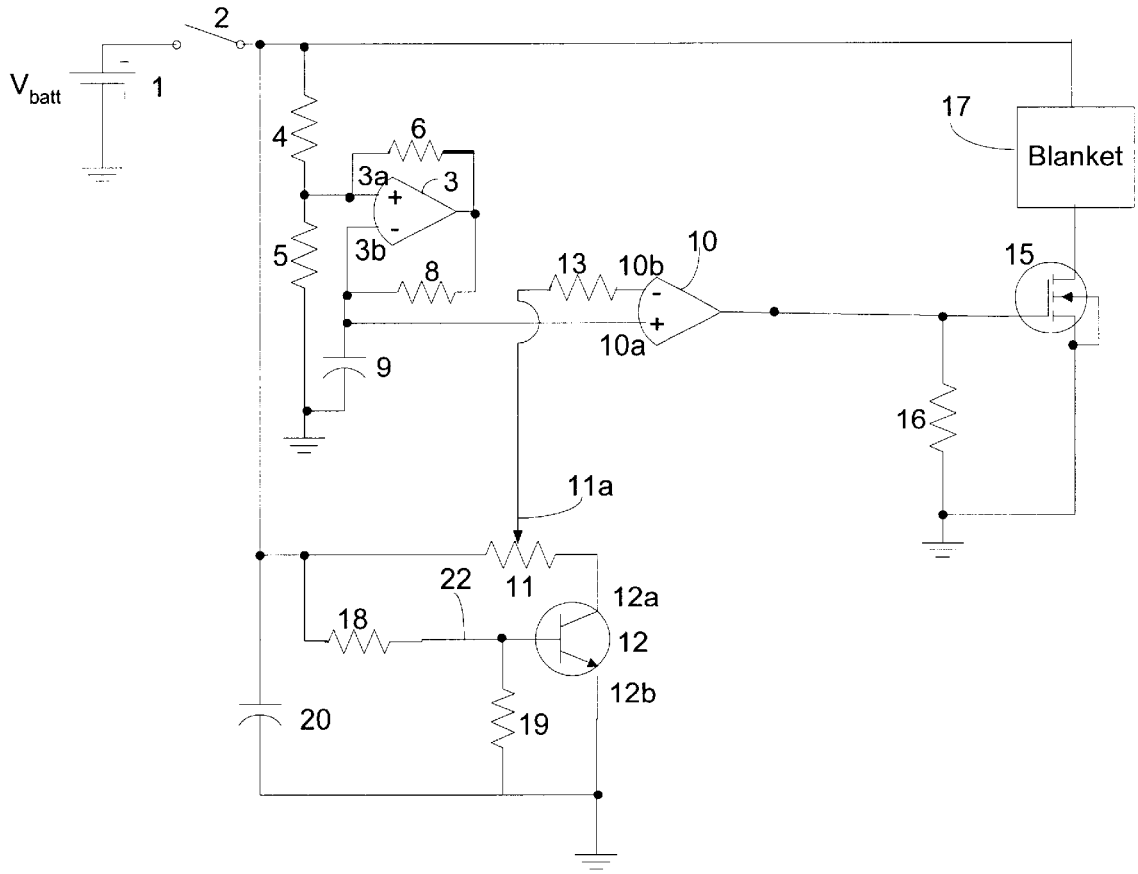
FIG. 2 is a circuit schematic in partial block circuit form showing the control circuit according to a first embodiment of the invention.

FIG. 2 shows a circuit diagram of an electric heating blanket incorporating a PWM controller with automatic low battery power reduction employing the principles of a first embodiment of the invention. A battery 1, for example, provides power to the circuitry of the invention through "on/off" switch 2. Comparator 3 is connected to resistors 4, 5, 6, and 8 and to capacitor 9 to comprise a triangle wave oscillator. Comparator 3 has a positive input 3*a* that is connected to a common junction between resistors 4 and 5, which form a voltage divider between the positive terminal of battery 1 and ground (or, correspondingly, the negative terminal of the battery). The output of comparator 3 is fed back to positive input 3*a* via resistor 6 and to the negative input 3*b* via resistor 8, which is also connected via capacitor 9 to ground. As a result of this configuration, a triangular voltage is developed across capacitor 9. This triangular voltage is fed to the non-inverting (positive) input 10*a* of a comparator 10. Comparator 10 has an inverting (negative) input 10*b* connected through a resistor 13 to a manually variable tap 11*a* of a potentiometer 11. This potentiometer is used to provide manual control. In a version of the electric heating blanket without the low voltage detection circuit, potentiometer 11 is connected between the positive terminal of battery 1 and ground. In a version having the low voltage detection circuit, potentiometer 11 is connected between the positive terminal of battery 1 and the collector 12*a* of a transistor 12 whose emitter 12*b* is connected to ground. In operation, a fixed frequency, variable duty cycle square wave is produced at the output of comparator 10 (i.e., when the voltage at positive input 10*a* exceeds the voltage at negative input 10*b*, a voltage is output by comparator 10, whereas such voltage is not output otherwise, thus producing a square wave). The duty cycle of this square wave may be manually controlled using the manually variable tap 11*a* of potentiometer 11. The square wave output from comparator 10 is then fed into the gate of a Field Effect Transistor (FET) 15. A common NPN-type transistor may be used in place of FET 15. A resistor 16 is connected between FET 15 and ground. The source of FET 15 is grounded, and heating blanket 17 is connected directly to the drain of FET 15. The other side of heating blanket 17 is connected to the positive terminal of battery 1. The circuit described above results in the "on time" of the blanket being completely variable from 0% to 100%. If the "on time" of the blanket is any duration less than 100%, the power drawn from battery 1 by the blanket is reduced. Specifically, at a 50% duty cycle, the power drain from the battery is effectively reduced by the same percentage, thus resulting in a longer usable run time at a reduced output (that is, in the case of a heating blanket, a reduced heat output).

According to a further aspect of the invention, the life of battery 1 may be extended by automatically and continually reducing the duty cycle of the PWM output of comparator 10 when the voltage of battery is reduced to a certain level, for example, 80% of its maximum level. To accomplish this, there is provided a low voltage detection circuit that gradually turns transistor 12 off when the battery voltage is depleted to a certain level; that is, as the battery voltage decreases below a predetermined level, the voltage being supplied to potentiometer 11 by transistor 12 will be gradually increased, as will be further described below.

In FIG. 2, the low voltage detection circuit comprises resistors 18 and 19 connected in series between the positive terminal of battery 1 and ground, with a capacitor 20 connected in parallel with the two resistors, between ground and the positive terminal of battery 1. The base of transistor 12 is connected to common terminal 22, which is the connection point between resistors 18 and 19. The values of resistors 18 and 19 are selected so that when the voltage of battery 1 is depleted to a certain level, for example, 80% of its rated value, the base voltage of transistor 12 is reduced to the point where transistor 12 begins to turn off. Gradually turning transistor 12 off gradually raises the voltage at the wiper arm of potentiometer 11, reducing the output duty cycle at the output of comparator 10 (i.e., by increasing the comparator threshold voltage at negative input 10*b*), thereby reducing the output power to the blanket. As the battery voltage decays to an even lower level, for example, 10% of its rated voltage level, transistor 12 turns off completely and reduces the output of comparator 10 to a zero (0) duty cycle.

Figure 3:
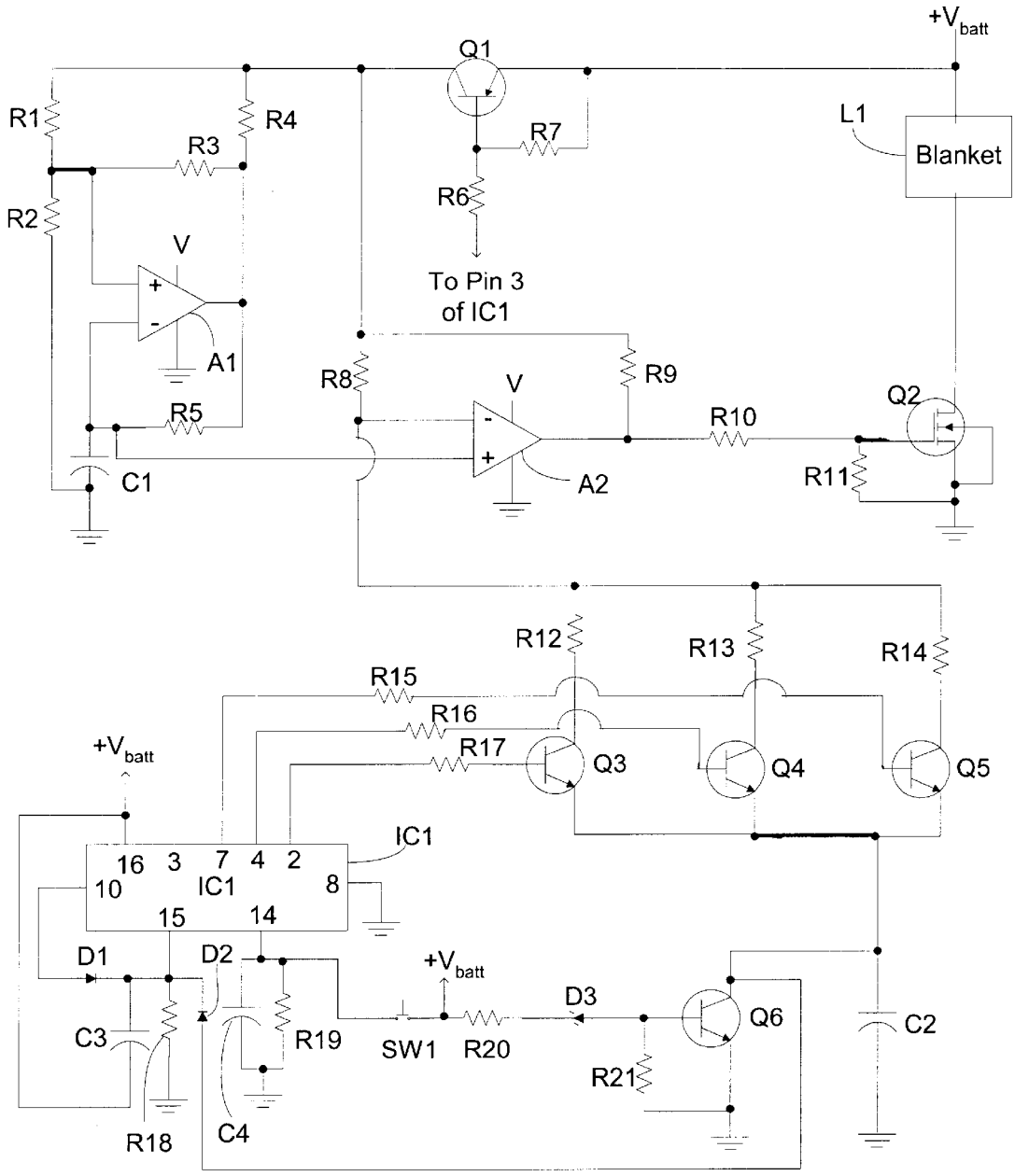
FIG. 3 is a circuit schematic in partial block circuit form showing the control circuit according to a second embodiment of the invention.

FIG. 3 depicts a circuit diagram according to a second embodiment of the invention. This second embodiment also incorporates automatic reduction in heating and shutdown, similar to the first embodiment, while adding additional power saving features. In FIG. 3, elements R1–R5, A1, and C1 comprise a triangular wave oscillator, similar to that in FIG. 2. Also similarly to FIG. 2, elements R8, R9, and A2 of FIG. 3 comprise a square wave generator that receives the output of the triangular wave oscillator as input. Transistor Q2 corresponds to transistor 15 of FIG. 2 and performs the same function. The base of transistor Q2 is fed by the output of a voltage divider formed by resistors R10 and R11, which help regulate the voltage being applied. Note that a separate on-off switch, component 2 in FIG. 2, is not shown in FIG. 3 but may be interposed between a power source (not shown) and the rest of the circuit.

The primary difference between the embodiments of FIGS. 2 and 3 lies in the control circuitry, which, in FIG. 3, is centered around IC1. In a preferred embodiment, IC1 comprises a 4017B decade counter. The involvement of IC1 with the various functions of the circuit will become clear from the discussion below.

As shown in FIG. 3, input to amplifiers A1 and A2 is controlled by transistor Q1. Transistor Q1 is configured with its collector coupled to the battery voltage (possibly via a switch as in FIG. 2) and its emitter coupled to one end of resistor R1, to one end of resistor R4, to one end of resistor R8, and to one end of resistor R9. The battery voltage is also coupled to the base of Q1 via resistor R7. The base is further coupled to Pin 3 of IC1 via resistor R6. Q1, as thus configured, functions as a switch and is on whenever the output of Pin 3 of IC1 is low (i.e., whenever the circuit is not off). This serves a function of reducing standby power consumption when IC1 is reset; as a result, when IC1 is reset, power consumption is on the order of micro-amperes. When Pin 3 of IC1 goes high, or when IC1 is reset (see below), transistor Q1 is rendered non-conductive, such that a signal is not output from the emitter of Q1, and blanket L1 is shut off.

As was the case in FIG. 2, the embodiment of FIG. 3 also provides means by which manual control may be accomplished. In FIG. 2, such means were provided by potentiometer 11. In FIG. 3, such means are provided by the combination of IC1 with transistors Q3–Q5 and resistors R12–R17, in further combination with selector switch SW1. Resistors R12–R14 are coupled to the collectors of transistors Q3–Q5, respectively. The bases of transistors Q3–Q5 are coupled, through resistors R17-R15, respectively, to Pins 2, 4, and 7, respectively, of IC1. In this configuration, under control of IC1, only one of the transistors will be conductive at any given time. As a result, a voltage divider circuit is formed by one of resistors R12–R14 in combination with resistor R8, depending on which of transistors Q3–Q5 is conductive. Because resistors R12–R14 have different values, the output of the voltage divider, which provides the threshold voltage of the comparator circuit forming the square wave generator comprising amplifier A2, varies according to which of transistors Q3–Q5 is conductive. A user employs selector switch SW1 to select which one of transistors Q3–Q5 is conductive.

In particular, selector switch SW1 is coupled between the power source ($+V_{batt}$) and Pin 14 of IC1, which represents the clock input of the 4017B decade counter. Pin 14 is further coupled to ground via capacitor C4 and resistor R19. IC1 works by sequentially placing high signals on its ten output pins. Pins 2, 4, and 7 go high, in that order, as clock pulses are applied to Pin 14, as a result of a user sequentially pushing selector switch SW1. When one of these pins goes high, the transistor (Q5, Q4, or Q3) to which it is coupled will conduct, and the corresponding resistor (R14, R13, or R12) will form the voltage divider with resistor R8, as discussed above, thus varying the threshold voltage (negative input) to amplifier A2 in a discrete fashion (thus changing the duty cycle of the output square wave, and thus the heating level, in a discrete fashion).

In FIG. 3, transistor Q6 provides functionality corresponding to that of transistor 12 in FIG. 2. In particular, the collector of transistor Q6 is coupled to the emitters of transistors Q3–Q5. As was the case with transistor 12 of FIG. 2, transistor Q6 performs the function of changing the duty cycle of the output square wave supplied by amplifier A2, regardless of which of transistors Q3–Q5 is conducting, thus providing automatic power reduction.

In particular, the base of transistor Q6 is coupled to the power source via resistor R20 and Zener diode D3. It is also coupled to ground via resistor R21. The emitter of transistor Q6 is also coupled to ground. The collector of transistor Q6, in addition to being coupled to the emitters of transistors Q3–Q5, is also coupled to ground via capacitor C2. It is further coupled to Pin 15 of IC1 via diode D2; this connection will be discussed further below.

Given the configuration of transistor Q6, when power supply voltage is above a predetermined level, settable by setting the values of resistors R20 and R21, Q6 is in a conductive state. As the power supply voltage decreases below the predetermined level, Q6 is rendered gradually less conductive, until, at some predetermined point, Q6 shuts off, altogether (i.e., becomes non-conductive). As was the case with transistor 12 of FIG. 2, this has the effect of increasing the voltage level at the negative input to amplifier A2, resulting in a shorter duty cycle, until the voltage level becomes high enough that the duty cycle is reduced to zero. Transistor Q6 thus serves the purpose of providing a low voltage detection circuit that automatically reduces, and ultimately inhibits, the heat output of the blanket L1.

IC1 further comprises a reset input at Pin 15. Pin 15 is connected to the collector of transistor Q6 via diode D2, as mentioned above. It is further connected to Pin 10 of IC1 via diode D1 and to ground via resistor R18. Finally, it is connected to the power supply voltage via capacitor C3. When IC1 receives a reset signal at Pin 15, it goes into an initial state (discussed further below), and the control circuit goes into a power conservation ("sleep") mode. Therefore, as transistor Q6 gradually shuts off, the voltage at its collector increases until it reaches a level such that a reset signal is generated at Pin 15, sending the circuit into its power conservation mode.

Reset signals may be generated at Pin 15 in two ways in addition to when the power supply voltage becomes too low. First, capacitor C3 causes this to happen upon power-up. Second, the user may, by using the selector switch, cause a high output at Pin 10 (which is the next pin, in sequence, to go high, following Pins 2, 4, and 7). When IC1 is reset, blanket L1 is turned off. This is because, upon reset, Pin 3 goes high (which is also the initial power-up state of Pin 3), and Q1 does not output a voltage at its emitter, as discussed above.

Note that, as was the case with the circuit of FIG. 2, FETs may be interchanged with BJTs, NPN-type BJTs may be interchanged with PNP-type BJTs, and N-channel FETs may be interchanged with P-channel FETs, with attendant changes in the accompanying circuitry. Furthermore, although FIG. 3 shows only three transistor-resistor pairs that provide discrete levels of output (i.e., Q3 and R12, Q4 and R13, and Q5 and R14), any desirable number of such pairs may be provided.

The low voltage detection circuits described above accomplish two objects of the invention. First, the load power is automatically reduced to a lower level as the battery discharges, thus increasing "run time." Secondly, the battery is prevented from totally discharging, which could prevent the battery from being fully recharged to its rated value, in the case of a rechargeable battery.

The embodiments illustrated and discussed in this specification are intended only to teach those skilled in the art the best way known to the inventors to make and use the invention. Nothing in this specification should be considered as limiting the scope of the present invention. The above-described embodiments of the invention may be modified or varied, and elements added or omitted, without departing from the invention, as appreciated by those skilled in the art in light of the above teachings. It is therefore to be understood that, within the scope of the claims and their equivalents, the invention may be practiced otherwise than as specifically described.

What is claimed is:

1. A pulse-width modulation (PWM) controlled electric heating blanket comprising:

electric heating means of the electric heating blanket;

a square wave generator producing a square wave output, a duty cycle of the square wave output being controllable by a control input, the square wave output being coupled to the electric heating means;

manual control means for varying a control signal input to the control input of the square wave oscillator and thereby controlling the duty cycle of the square wave output; and a low voltage detection circuit for monitoring the voltage level of a power source and providing a control signal to the control input of the square wave oscillator, to thereby decrease the duty cycle of the square wave output when the voltage level of the power source decreases below a predetermined level.

2. The electric heating blanket according to claim 1, wherein the control signal provided by the low voltage detection circuit is provided to the control input of the square wave oscillator via the manual control means.

3. The electric heating blanket according to claim 1, wherein the low voltage detection circuit comprises a control transistor, wherein the control transistor is gradually turned off as the voltage level of the power source decreases below the predetermined level.

4. The electric heating blanket according to claim 1, wherein the square wave generator comprises a comparator circuit having a threshold level set by the control input.

5. The electric heating blanket according to claim 4, further comprising:

a triangular wave oscillator producing a triangle wave signal, wherein the triangle wave signal is provided as input to the square wave generator for comparison to the threshold level by the comparator circuit.

6. The electric heating blanket according to claim 1, further comprising a switching means to which the square wave output is provided, to thereby control application of power to the electric heating means.

7. The electric heating blanket according to claim 6, wherein the switching means comprises a transistor.

8. The electric heating blanket according to claim 1, wherein the power source comprises a battery.

9. The electric heating blanket according to claim 1, wherein the power source comprises a rechargeable battery.

10. The electric heating blanket according to claim 1, wherein the manual control means comprises a potentiometer.

11. The electric heating blanket according to claim 1, wherein the manual control means comprises:

a plurality of transistors;

a plurality of resistor means, corresponding in number to the plurality of transistors, each having a different value, and each coupled to a different one of the plurality of transistors; and a selector switch coupled to selected one or none of the plurality of transistors to be conductive.

12. The electric heating blanket according to claim 11, further comprising:

an integrated circuit coupled to the selector switch, wherein one or none of the plurality of transistors is enabled to conduct by an output of the integrated circuit generated in response to use of the selector switch.

13. The electric heating blanket according to claim 12, wherein the integrated circuit comprises a decade counter.

14. The electric heating blanket according to claim 12, wherein the integrated circuit includes a reset input coupled to reset the circuit upon any one of power-up, low power source voltage, and use of the selector switch to turn off the electric heating means, wherein the reset mode results in power to the electric heating means being cut off and the integrated circuit going to an initial state.

15. The electric heating blanket according to claim 1, further comprising a transistor coupled to the square wave generator and arranged so as to permit and shut off input to the square wave generator.

16. The electric heating blanket according to claim 15, further comprising:

an integrated circuit having an output coupled to the transistor to control the transistor to permit and shut off input to the square wave generator.

17. The electric heating blanket according to claim 16, further comprising:

a selector switch coupled to the integrated circuit;

wherein the integrated circuit includes a reset input; and wherein the reset input is arranged so that the integrated circuit resets when at least one of a low power condition, a power-up condition, or a manual turn-off condition occurs.

18. The electric heating blanket according to claim 17, wherein, when the integrated circuit resets, the integrated circuit output coupled to the transistor causes the transistor to shut off input to the square wave generator.

19. A method of controlling an electric heating blanket, the method comprising the steps of:

generating a square wave signal having a controllable duty cycle, the square wave signal being coupled to an electric heating means of the electric heating blanket for controlling the electric heating means; and controlling the duty cycle of the square wave signal, the step of controlling the duty cycle comprising:

monitoring a voltage level of a power source; and decreasing the duty cycle of the square wave signal when the voltage level of the power source decreases below a predetermined level.

20. The method according to claim 19, wherein the step of decreasing the duty cycle of the square wave signal comprises the step of increasing a threshold voltage used in a signal comparison.

21. The method according to claim 20, further comprising the step of:

generating a triangle wave signal, wherein the triangle wave signal is used in the signal comparison to generate the square wave signal.

22. The method according to claim 19, wherein the step of controlling the duty cycle of the square wave signal further comprises the step of:

manually controlling the duty cycle of the square wave signals; and wherein the step of decreasing the duty cycle of the square wave signal comprises the step of decreasing the duty cycle of the square wave signal below a duty cycle set by the step of manually controlling the duty cycle of the square wave signal.

23. The method according to claim 19, wherein the step of controlling the duty cycle of the square wave signal comprises the step of manually setting a threshold level for performing a signal comparison.

24. The method according to claim 23, further comprising the step of:

generating a triangle wave signal, wherein the triangle wave signal is used in the signal comparison to generate the square wave signal.

25. The method according to claim 23, wherein the step of manually setting a threshold level for performing a signal comparison comprises the step of manually selecting a threshold voltage from within a continuous voltage range.

26. The method according to claim 23, wherein the step of manually setting a threshold level for performing a signal comparison comprises the step of manually selecting a threshold voltage from among a discrete set of voltage levels.

27. The method according to claim 19, further comprising the step of:

using the square wave signal to switch power to the electric heating means on and off.

* * * * *